US005220722A

United States Patent [19]

Milliman

[11] Patent Number: 5,220,722

[45] Date of Patent: Jun. 22, 1993

[54] QUICK HEIGHT CHANGE ADJUSTMENT FOR TUBE EXPANDER

[75] Inventor: James G. Milliman, Fawn River Township, St. Joseph County, Mich.

[73] Assignee: Burr Oak Tool & Gauge Company, Sturgis, Mich.

[21] Appl. No.: 805,204

[22] Filed: Dec. 9, 1991

[51] Int. Cl.[5] ..... B23P 15/26

[52] U.S. Cl. ..... 29/727; 29/33 G; 29/726; 29/890.043

[58] Field of Search ..... 29/890.043, 726, 727, 29/33 G, 33 T

[56] References Cited

U.S. PATENT DOCUMENTS

| | | | |
|---|---|---|---|
| 3,688,533 | 9/1972 | Ames | 72/22 |
| 4,584,751 | 4/1986 | Gray et al. | 29/157.3 |
| 4,597,171 | 7/1986 | Kitayama et al. | 29/727 |
| 4,839,828 | 6/1989 | York et al. | 29/727 |
| 4,839,950 | 6/1989 | Stroup | 29/727 |
| 5,003,691 | 4/1991 | Milliman et al. | 29/727 |
| 5,040,405 | 8/1991 | Honma et al. | 29/727 |
| 5,099,677 | 3/1992 | Tokura | 29/727 |

*Primary Examiner*—Irene Cuda

*Attorney, Agent, or Firm*—Flynn, Thiel, Boutell & Tanis

[57] ABSTRACT

A mechanical tube expander having a construction which facilitates a machine setup prior to coil assembly without necessitating the machine operator to leave a control panel, this being due to all setup and locking features being accomplished from the control panel. Thus, an operator climbing on ladders to various and remote locations on the machine are not necessary. This feature is accomplished by orienting a pre-size clamp and a strip clamp on opposite sides of the stripper plate and tracking the position of the stripper plate relative to the receiver in order to enable the pre-size clamp to be correctly positioned and clamped to a piston rod driven upwardly by pressurized air. Any retraction of the piston rod will cause oil to be drawn into the upper end of the piston and cylinder assemblies so that at the bottom-most stroke of the mechanical tube expander, a valve will be activated to block outflow of oil at the same time that the stripper clamp is clamped to allow bullets to be removed from the tubes in an assembly of fins, after the withdrawal of such bullets the stripper clamp is unclamped to allow the mechanical tube expander to return to a predetermined position to enable another operative sequence to take place.

4 Claims, 8 Drawing Sheets

QUICK HEIGHT CHANGE ADJUSTMENT FOR TUBE EXPANDER

FIELD OF THE INVENTION

This invention relates to a mechanical tube expander and, more particularly, to a mechanical tube expander having structure thereon for facilitating a quick adjustment in order to accommodate coil constructions of differing heights.

BACKGROUND OF THE INVENTION

Tube and fin type heat exchangers employing hairpin tubes (U tubes) or straight tubes are assembled into a mechanical tube expander by expanding the tubes into interference fit with the fins and end sheets of the heat exchanger. The hairpin tubes (U tubes) are comprised of two straight legs and a bend which is bent through an arc of 180°. The length of the two straight legs determines the finished coil height and the number of fins that are to be stacked one on top of the other and laced through holes provided in the fins. Finished coil assemblies come in a variety of heights and widths. During assembly of the coil constructions, it is oftentimes necessary to shift assembly operations from one coil construction to another. As a result, an operator must climb on a ladder to access the various adjustment features on the machine and, in some instances, the operator will need to move up and down the ladder several times at differing locations on the machine just to effect a repositioning of the various control elements on the machine. Movements of the operator up and down ladders is both time consuming and, in some instances, an occupational hazard. It is, therefore, desirable to provide a construction which will quickly accommodate a switch over from one coil assembly to another with a differing height in a most expeditious manner.

Accordingly, it is an object of this invention to provide a mechanical tube expander having structure thereon for facilitating an adjustment of the expander to accommodate differing coil heights without necessitating the operator moving up and down ladders to access the various adjustment features on the expander.

It is a further object of the invention to provide a mechanical tube expander, as aforesaid, which has a control panel having controls thereon enabling the operator to set up the machine for differing coil heights while remaining at the control panel.

It is a further object of the invention to provide a mechanical tube expander, as aforesaid, which is easy to operate and which eliminates the hazards of the working environment associated with a set up operation for the mechanical tube expander.

SUMMARY OF THE INVENTION

The objects and purposes of the invention are met by providing a mechanical tube expander for expanding hairpin tubes or straight tubes into interlocked relationship with fins, which expander includes a frame, a receiver mounted on the frame and adapted to support the bent portions of the hairpin tubes. An assembly of fins is loosely stacked on the hairpin tubes and supported on the receiver. A pressure plate carrying a plurality of expander rods which are aligned with the hairpin tubes, which expander rods include tube-expanding bullets at one end thereof, is driven toward and away from the assembly of fins in order to effect a driving of the bullets into the tubes to expand them and to effect an interlocked relationship of the fins to the exterior surface of the tubes as well as retracting the bullets from within the tubes. A stripper plate having a plurality of guide openings therethrough through which extend the expander rods is provided for engaging the assembly of fins on an end thereof remote from the receiver, the stripper plate being moveable relative to the frame toward and away from the receiver by the drive mechanism for the pressure plate. A pair of laterally spaced internally threaded nuts are provided on an expander plate and elongated pressure screws are threadedly received in each of the threaded nuts. A drive mechanism is provided for simultaneously rotating each of the screws relative to the nuts to, therefore, cause the screws to be adjusted vertically relative to a bolster plate on which the receiver is mounted. A pair of fluid cylinders are provided on opposite sides of the frame, which fluid cylinders each have a main chamber and a piston dividing the main chamber into first and second chambers. A piston rod is secured to each piston. A source of pressurized compressible fluid and a connection therefor is provided for facilitating a connection of each of the second chambers to the fluid source and a continuous urging of the pistons toward one end of the main chamber. First and second block members are slidably mounted on each of the piston rods for movement longitudinally thereof, the first block member being also mounted on and moveable with the stripper plate and is oriented on a side of the stripper plate remote from the receiver. Additional support means are provided for suspending the second block member from the stripper plate and providing a limit distance that each second block member is suspended along the piston rods away from the first block members and the stripper plate. Releasable clamping structure is provided on each of the first and second block members for fixedly clamping the first and second block members to the piston rod. Control means are provided for effecting a complete cycle of operation to cause the hairpin tubes to be expanded into interlocked relationship with the fins as well as facilitating an initial setup of the mechanical tube expander to accommodate a desired height of an assembly of fins.

BRIEF DESCRIPTION OF THE DRAWINGS

Other objects and purposes of this invention will be apparent to persons acquainted with apparatus of this general type upon reading the following specification and inspecting the accompanying drawings, in which.

Figure 1:
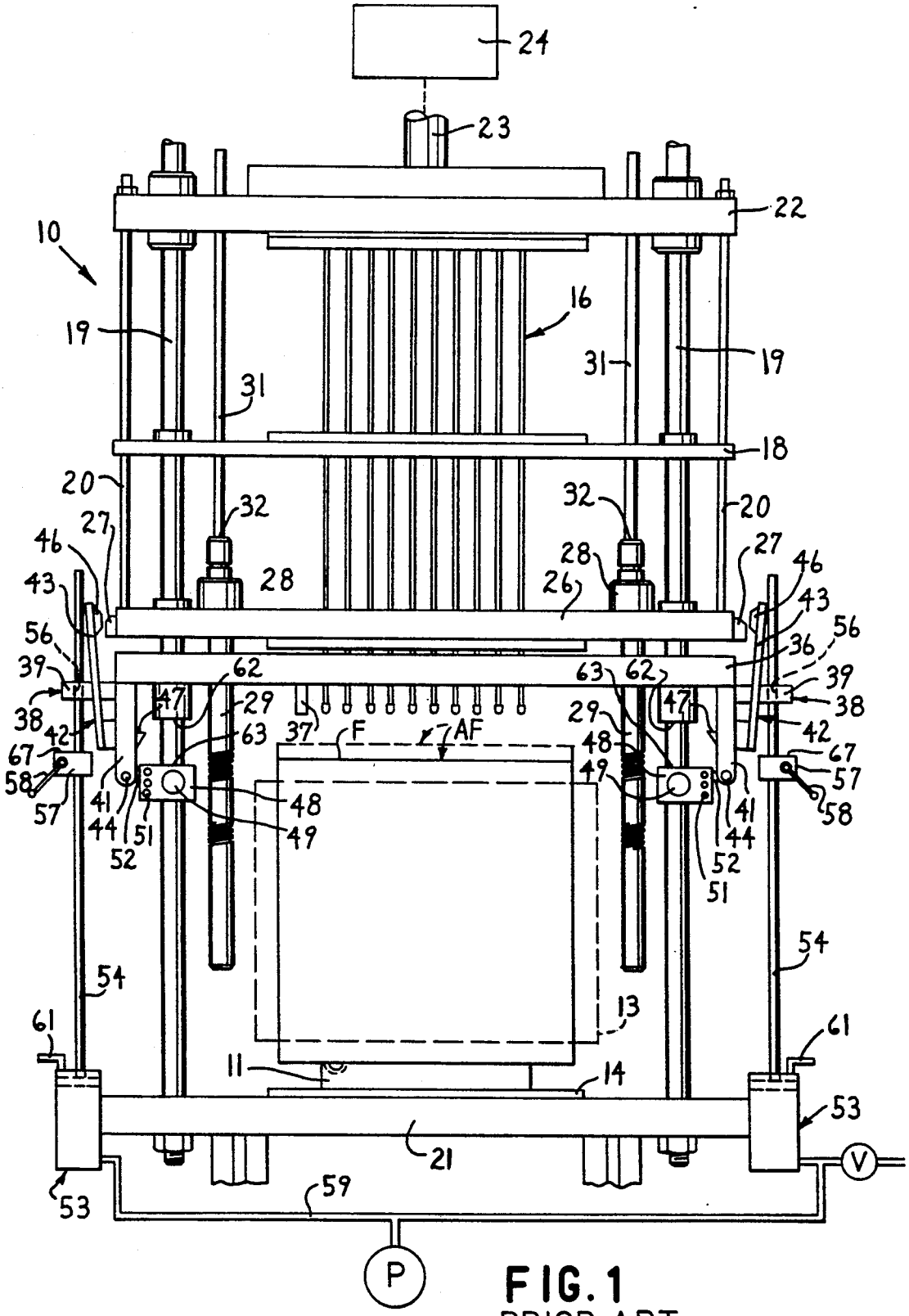
FIG. 1 PRIOR ART
FIG. 1 is a front view of a conventional mechanical tube expander in a first position of operation.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

DESCRIPTION OF KNOWN PRIOR ART

Figure 2:
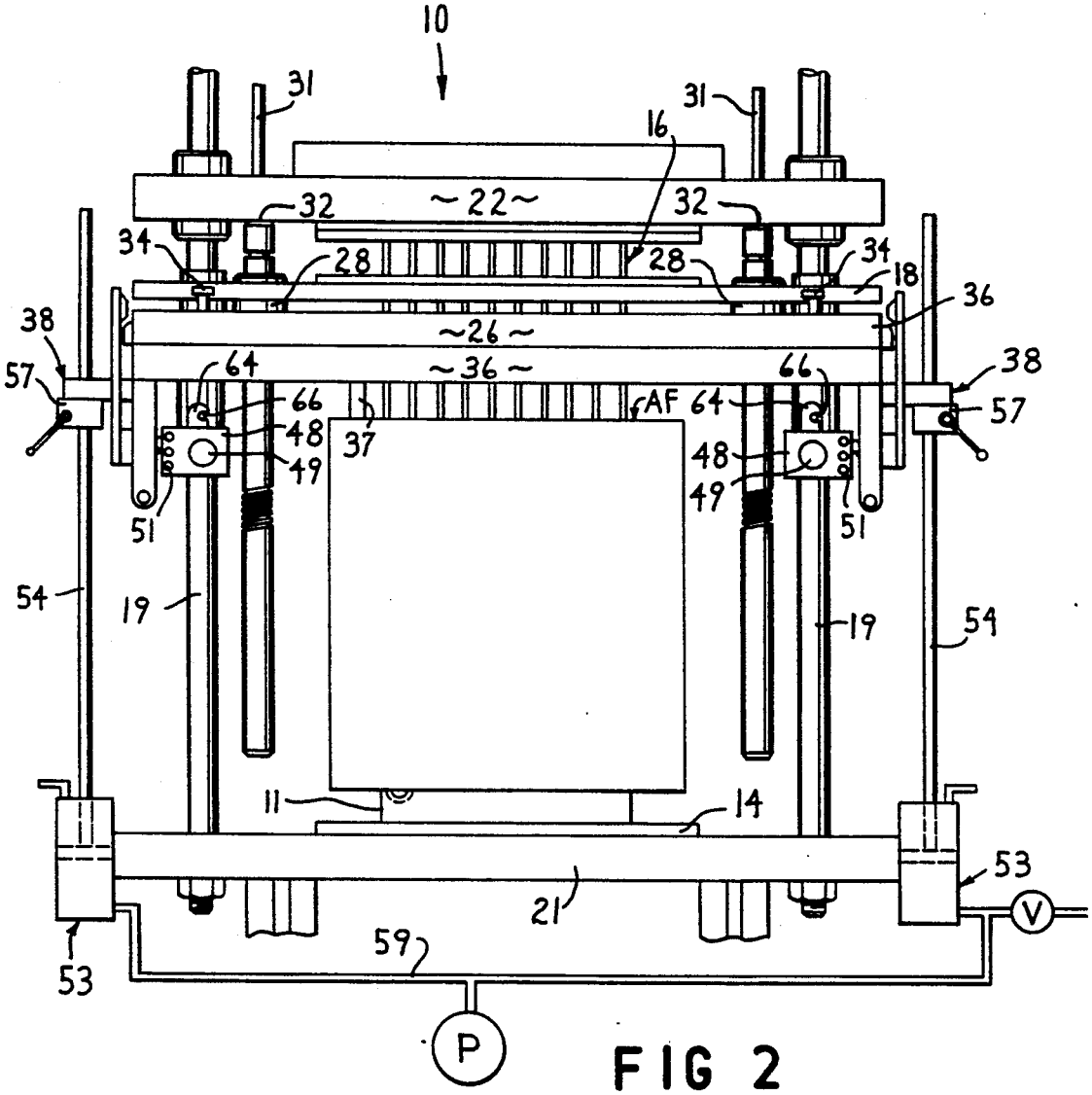
FIG 2 PRIOR ART
FIG. 2 is a front view of a mechanical tube expander illustrated in FIG. 1, but moved to a second position of operation thereof.
Figure 3:
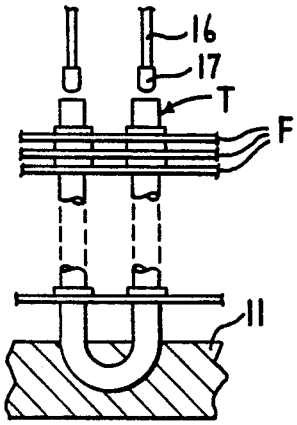
FIG. 3 is a fragmentary enlargement of an assembly of fins mounted on a hairpin tube supported on a receiver.

FIGS. 1-3 of this application illustrates known prior art relating to a mechanical tube expander. Devices of this type can be oriented both vertically and horizontally. The type of construction illustrated in FIGS. 1-3 relate to a vertically oriented device wherein the overall height is approximately that of a two story building. In order to accommodate coil constructions of differing heights, such as will occur when a changeover is to take place from one coil construction to another coil construction, ladders employed by the setup people are required in order to make the appropriate adjustments to the machine. In order to better understand the nature of the adjustments that need to be made in the prior art machine, it will be necessary to describe the prior art machine and such description is set forth in the next preceding paragraphs.

Referring to FIG. 1, there is illustrated a vertical tube expander 10 comprising a frame 12 (See FIG. 4) on which a hairpin supporting receiver 11 is mounted. The tubes T and the fins F to be interlocked with the tubes (see FIG. 3) are disposed in a fixture 13. The tubes T are oriented vertically and the fins F are loosely stacked thereon. The hairpin supporting receiver 11 supports the reversely curved (hairpin bent) lower ends of the tubes. The receiver 11 is supported on a receiver support plate 14 mounted on [the frame 12] a bolster plate 21.

A plurality of expander rods 16 corresponding in number and arrangement to the number and arrangement of tubes T, is provided for expanding the tubes. At their lower ends, the expander rods carry expander bullets 17 (see FIG. 3) which are effective to expand the tubes into interlocked engagement with the fins when the expander rods are moved vertically downwardly through the tubes. The expander rods 16 extend through plural, vertically movable, guide plates 18, suspended from a pressure plate 22 by not illustrated tie rods, so that the lower ends of the expander rods will remain vertically aligned with the tubes T. Vertical guide rods 19 are provided for guiding the reciprocating. movement of the reciprocal parts of the mechanical tube expander such as the pressure plate 22 and the guide plates 18. The vertical guide rods 19 are mounted on the sturdily constructed bolster plate 21 part of the frame 12. The receiver support plate 14 is mounted on the upper surface of the bolster plate 21. The pressure plate 22 is provided for supporting the expander rods 16 for vertical reciprocating movement. The pressure plate 22 is vertically slidably guided by the rods 19. The pressure plate 22 is connected to a ram piston rod 23 of a piston and cylinder assembly schematically indicated by the reference character 24 so that the pressure plate 22 can be driven toward and away from the receiver 11.

A final expander plate 26 is vertically slidably movable on the guide rods 19 and, like the guide plates 18, are suspended from the pressure plate 22, but by tie rods 20. The expander plate has not illustrated structure thereon for flaring the upwardly facing open ends of the tubes T, particularly during the final stages of the stroke from the piston and cylinder assembly 24. The expander plate 26 has on laterally opposite sides thereof projections 27. A pair of internally threaded nuts 28 are mounted on the upper surface of the expander plate 26 and threadedly receive therein an elongated screw 29. Each screw 29 has an elongated rod 31 extending upwardly therefrom through openings provided in the guide plates 18 and the pressure plate 22. A motorized drive arrangement (not illustrated) is provided for driving the rods 31 for rotation and, consequently, the screws 29 for rotation within the stationary nuts 28. Both of the screws 29 are oriented so that the upper ends 32 are coplanar and remain coplanar as the motorized drive means alters the vertical position thereof.

A stripper plate 36 is slidably mounted on the guide rods 19 and are suspended by stripper bolts 34 (FIG. 2) a predetermined distance from the expander plate 26. The stripper plate 36 has a plurality of stripper posts 37 projecting downwardly therefrom, only one of which is illustrated in FIGS. 1 and 2. The stripper posts 37 are intended to engage the upper fin F of an assembly of fins AF for the purpose of facilitating a removal of the bullets 17 from within the tubes T following an expansion of the tubes T into interlocking relation with the fins F.

A pair of brackets 38 are provided on opposite lateral sides of the stripper plate 36. Each bracket 38 includes a guide block 39 extending horizontally outwardly in a plane generally parallel to the plane of the stripper plate 36. The brackets 38 each include a downwardly extending arm 41 to which is pivotally secured a two arm latch mechanism 42. Each latch mechanism 42 includes an elongated lever arm 43 extending away from the pivot axle 44 on one side thereof. The outermost end of the lever arm 43 has a projection 46 thereon adapted to operatively engage and disengage from the projection 27 on the expander plate 26. A spring mechanism (not illustrated) is provided for continually urging the left lever arm 43, as viewed in FIG. 1, clockwise about the pivot axle 44 therefor and the right lever arm 43 counterclockwise about the pivot axle 44 therefor. The latch mechanism 42 includes a latch projection 47, the purpose of which will be set forth in more detail below.

A holding block 48 is slidably movably oriented on each of the guide rods 19 and is positioned between the bolster plate 21 and the underside of the stripper plate 36. Each holding block includes a manually operable knob 49 for facilitating a manipulation of a hook-like member 64 into engagement with a pin 66. In order to permanently affix the holding block 48 to the guide rod 19, a plurality of screws 51 are provided, it being recognized that the holding block 48 is somewhat C-shaped and encircles the guide rod 19 with the free ends of the C-shaped construction being connected together by the aforementioned screws 51. A projection 52 is provided on the holding block 48 and is adapted to operatively engage the latch projection 47 on the latch mechanism 42.

A pair of piston and cylinder assemblies 53 are mounted on laterally opposite ends of the bolster plate 21 and are oriented so that each piston rod 54 thereof extends vertically upwardly parallel to the guide rods 19. Each piston rod 54 extends through a guide opening 56 in the guide block 39. A pre-sizer actuator block 57, the position of which can be vertically adjusted along the length of the piston rod 54 by loosening and tightening a clamp actuated by a lever arm 58, is provided on each of the piston rods 54 at a location that is beneath the guide blocks 39.

A source P of pressurized fluid, here air, is connected via pipes 59 or the like to the bottom end of the cylinder part of each of the piston and cylinder assemblies 53 to continually urge the pistons therein and associated piston rods 54 vertically upwardly. A pipe 61 is connected to the upper end of the cylinder part of each of the piston and cylinder assemblies 53 in order to connect the upper end of the piston and cylinder assemblies 53 to the atmosphere. A valve V is provided in the pipe 59 to bleed off to the atmosphere any excess pressure that may develop inside the piston and cylinder assembly 53 when the pistons therein are urged toward the bottom end of the piston and cylinder assemblies 53.

In order to adjust the mechanical tube expander 10 to accommodate coil constructions of differing heights at the point in time where a changeover from one coil construction to another one is to occur, the first thing that the operator needs to do is to lower the stripper plate 36 until the downwardly facing surface 62 of the guide structure therefor around the guide rods 19 engages the upper surface 63 of the holding blocks 48 as shown in FIG. 2. Thereafter, the operator will need to climb up on a ladder (for tall coil heights—a ladder would probably not be required for short coil heights) and secure by means of a hook 64 and knob 49 (FIG. 2) pivotally secured to the holding block 48, the holding block 48 to a pin 66 provided on the guide structure for the stripper plate 36. This action will be required on both lateral sides of the machine and, therefore, the operator will need to move up and down ladders, if necessary, at two separate locations in order to accomplish this task. Thereafter, the operator will need to loosen each of the screws 51 to effect an unclamping of the holding block 48 from its fixably clamped relation with the guide rod 19. Following an unclamping of the holding blocks 48, the piston and cylinder assembly 24 can then be actuated in order to cause the pressure plate 22 to move either upwardly or downwardly to a desired location to orient the upper surface 63 of each of the holding blocks 48 to a finished coil height for the next coil structure to be assembled. Prior to this step, however, it will be necessary for the pre-sizer actuator blocks 57 to be lowered out of the way of movement of the brackets 38 provided on the stripper plate 36. Assuming that the holding blocks 48 have been moved to the proper finished coil height location, it will be necessary for the operator to again climb up on a ladder and retighten the screws 51 to fixedly orient the holding block 48 to the associated guide rod 19 (meaning that the operator will need to move up and down ladders at two separate locations). The hooks 64 can then be removed [by loosening knob 49] from engagement with the pins 66 by loosening knob 49 to allow the pressure plate as well as the expander plates and all plates 18 oriented thereabove to move vertically away from the newly positioned holding blocks 48. Since no coil is now present in the machine during an adjustment, there is no force being applied to the stripper plate.

In situations where a totally new coil construction is to be assembled, the aforementioned adjustment procedure can be quite cumbersome due to the fact that multiple repositionings of the holding block 48 will be necessary by trial and error until the final position of the upper surfaces 63 of the holding blocks 48 is appropriately determined. In other words, the operator will need to move up and down ladders at two separate locations a multiple number of times and effect tightenings and loosenings of screws using, in this particular embodiment, an allen wrench. In other words, a considerable amount of time is spent effecting a readjustment of the machine. During this time of adjusting the position of the holding blocks 48, the pre-sizer actuator blocks 57 are also moved so that the upper surfaces 67 thereof are oriented a certain specified distance above the upper surfaces 63 of the adjusted position of the holding blocks 48, thus, further movement of the operator up and down ladders.

DETAILED DESCRIPTION OF THE PREFERRED EMBODIMENT

Figure 4:
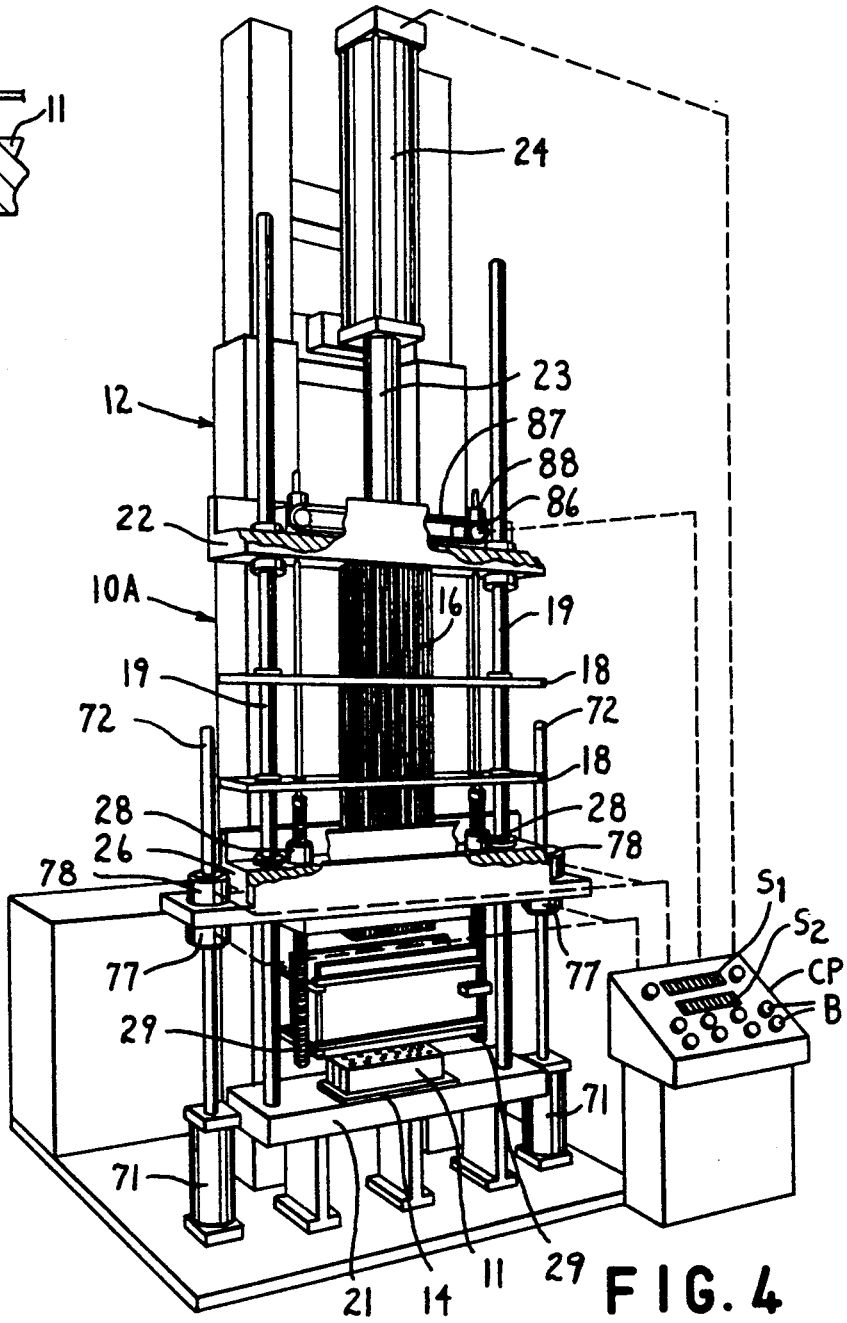
FIG. 4 is an isometric view of a mechanical tube expander embodying the invention.

The mechanical tube expander 10 shown in FIGS. 1 and 2 is similar in many respects to a modified mechanical tube expander 10A illustrated in FIG. 4. Yet, the differences are subtle and important. The mechanical tube expander illustrated in FIGS. 4–6 includes an alternate holding block and pre-sizer actuator block construction which makes it wholly unnecessary to utilize the afore-described complicated latch mechanism 42, holding blocks 48 and manually manipulatable pre-sizer actuator blocks 57.

Referring now to FIG. 4, there is illustrated a vertical modified tube expander 10A. The reference characters for the components that are the same as the components in the embodiment of FIGS. 1–2 will remain the same.

The expander comprises a frame 12 on which a hairpin supporting receiver 11 is mounted. The tubes T and the fins F to be interlocked with the tubes are disposed in a fixture 13. The tubes T are oriented vertically and the fins F are loosely stacked thereon. The hairpin supporting receiver 11 supports the reversely curved (hairpin bent) lower ends of the tubes. The receiver 11 is supported on a receiver support plate 14 mounted on the bolster plate 21.

A plurality of expander rods 16 corresponding in number and arrangement to the number and arrangement of tubes T, is provided for expanding the tubes. At their lower ends, the expander rods carry expander bullets 17 (see FIG. 3) which are effective to expand the tubes into interlocked engagement with the fins when the expander rods are moved vertically downwardly through the tubes. The expander rods 16 extend through plural, vertically movable, guide plates 18, suspended from a pressure plate 22 by not illustrated tie rods, so that the lower ends of the expander rods will remain vertically aligned with the tubes T. Vertical guide rods 19 are provided for guiding the reciprocating movement of the reciprocal parts of the mechanical tube expander such as the pressure plate 22 and the guide plates 18 expander plate 26 and stripper plate 36. The vertical guide rods 19 are mounted on a sturdily constructed bolster plate 21 part of the frame 12. The receiver support plate 14 is mounted on the upper surface of the bolster plate 21. The pressure plate 22 is provided for supporting the expander rods 16 for vertical reciprocating movement. The pressure plate 22 is vertically slidably guided by the rods 19. The pressure plate 22 is connected to a ram piston rod 23 of a piston and cylinder assembly schematically indicated by the reference character 24 so that the pressure plate 22 can be driven toward and away from the receiver 11.

An expander plate 26 is vertically slidably movable on the guide rods 19 and, like the guide plates 18, suspended from the pressure plate 22, but by tie rods 20. The expander plate has not illustrated structure thereon for flaring the upwardly facing open ends of the tubes T, particularly during the final stages of the stroke from the piston and cylinder assembly 24. A pair of internally threaded nuts 28 are mounted on the upper surface of the expander plate 26 and threadedly receive therein an elongated screw 29. Each screw 29 has an elongated rod 31 extending upwardly therefrom through openings provided in the guide plates 18 and the pressure plate 22. A motorized drive arrangement (not illustrated) is provided for driving the rods 31 for rotation and, consequently, the screws 29 for rotation within the stationary nuts 28. Both of the screws 29 are oriented so that the upper ends 32 are coplanar and remain coplanar as the motorized drive means alters the vertical position thereof.

A stripper plate 36 is slidably mounted on the guide rods 19 and suspended by stripper bolts 34 (FIG. 2) a predetermined distance from the expander plate 26. The stripper has a plurality of stripper posts 37 projecting downwardly therefrom, only one of which is illustrated in FIGS. 1 and 2. The stripper posts 37 are intended to engage the upper fin F of an assembly of fins AF for the purpose of facilitating a removal of the bullets 17 from within the tubes T following an expansion of the tubes T into interlocking relation with the fins F.

In this particular embodiment, it will be noted that the projections 27 on opposite lateral sides of the expander plate 26 are missing. Further, the brackets on opposite lateral sides of the stripper plate 36 are also missing.

The piston and cylinder assemblies 53 described in FIGS. 1 and 2 above have been replaced with different piston and cylinder assemblies 71, each having a piston moveable therein, to which piston is secured a piston rod 72 extending vertically generally parallel to the guide rods 19. A source P of compressed air is connected through piping or the like 73 to the cylinder port oriented beneath the pistons in each of the piston and cylinder assemblies 71. A valve $V_1$ is provided for bleeding off any excessive pressure that may build up inside the piston and cylinder assembly 71 as the pistons therein are urged toward the bottom of the respective stroke for the pistons. The upper end of the cylinder port above the pistons in each of the piston and cylinder assemblies 71 is, in this particular embodiment, connected through piping 74 to a valve $V_2$ which in turn is connected through piping 76 to a reservoir R of oil or the like. As the pistons in each of the piston and cylinder assemblies 71 is moved downwardly, oil will be drawn through the valve $V_2$ into the upper end of the piston and cylinder assemblies 71 as air is urged out of the lower end of the piston and cylinder assemblies through the relief valve $V_1$ to the atmosphere while retaining in the lower end of the piston and cylinder assemblies the requisite pressure determined by the setting on the relief valve $V_1$.

A combination of pre-size clamp 77 and strip clamp 78 are mounted on opposite lateral sides of the stripper plate 36 and are moveable relative to the piston rods 72. The strip clamp 78 is fixedly secured to the upper surface of a lateral extension 79 of the stripper plate 36. The strip clamp 78 encircles the piston rod 72 and has a hydraulic structure therewithin, schematically shown in broken lines at 68 in FIGS. 5 and 6, for constricting around and effecting a clamp of the strip clamp 78 to the piston rod 72. Suspended from the lateral extension 79 and the strip clamp 78 is a pre-size clamp 77 identical in construction to the strip clamp 78, it, too, having a hydraulically operated structure 68 therewithin constricting around the piston rod 72 to fixedly clamp the pre-size clamp 77 to the piston rod 72. In this particular embodiment, a post 81 is secured to the upper end of the pre-size clamp 77 and projects through an opening provided in the lateral extension 79 of the stripper plate 36 and through the mounting plate 82 for the strip clamp 78 to an enlarged cap retained by a not illustrated screw at the upper end of the post 81. The pre-size clamp 77 is capable of moving relative to the strip clamp 78 a prescribed distance $X_1$ illustrated in FIG. 7A. In one exemplary embodiment, the dimension $X_1$ is equal to 9.5 inches.

As shown in FIG. 4, a control panel CP is provided which has a plurality of control buttons B thereon and two small screens S for displaying numerical data indicating the position of the screws 29 relative to the nuts 28. The control panel CP includes all of the requisite control buttons B for effecting a coil height setup operation for the mechanical tube expander 10A without necessitating the operator leaving the control panel. For example, FIG. 8 illustrates a highly simplified schematic electrical control diagram enabling a manual operation of the control buttons B to effect a coil height setup of the mechanical tube expander as well as activating an automated operation control system to allow coil assembly, tube expansion, to occur in an automated manner following the setup operation.

Figure 8:
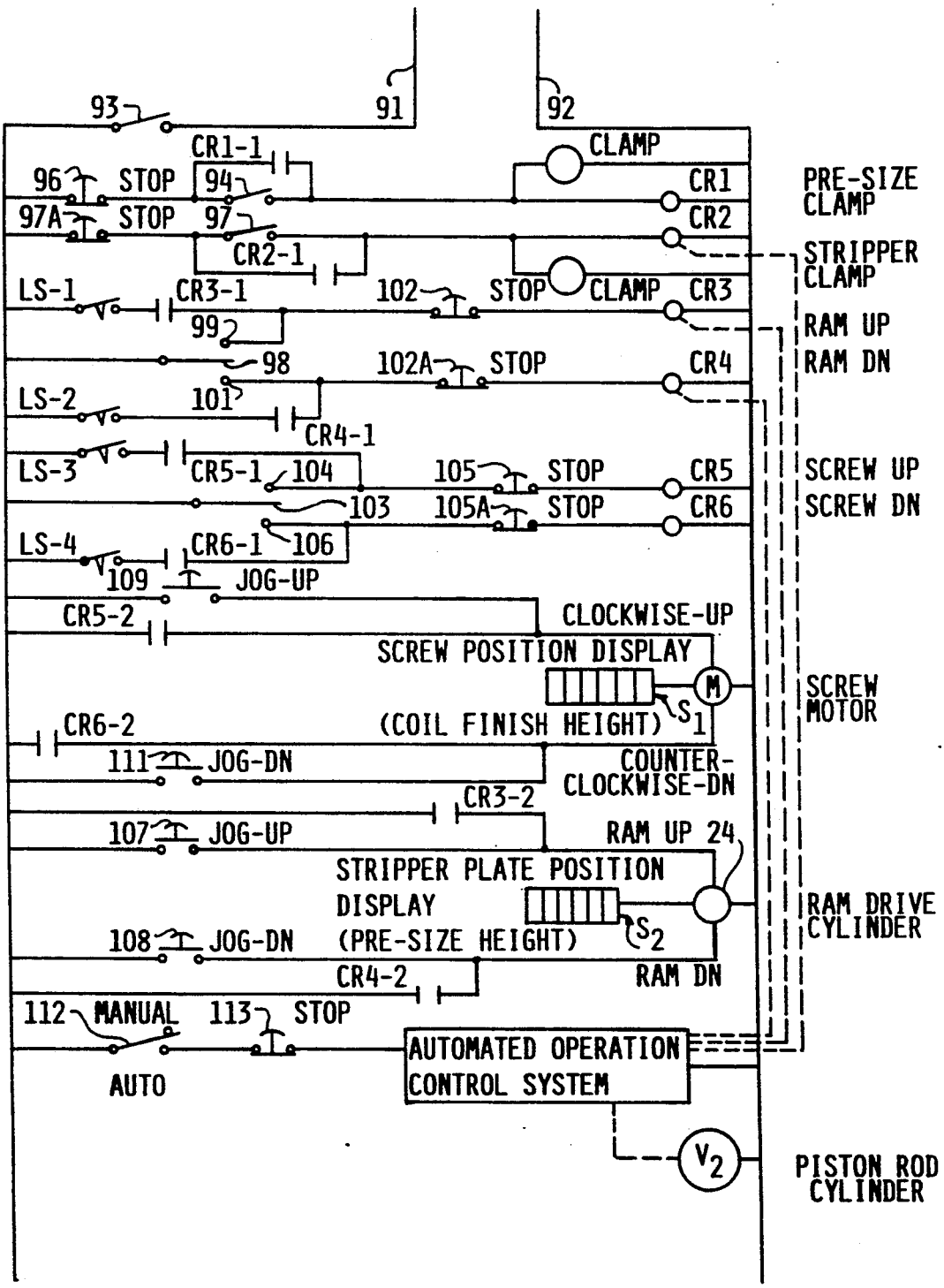
FIG. 8 is a schematic illustration of a control panel for controlling the operative sequences of the mechanical tube expander embodying the invention.

Referring to FIG. 8, electrical lines 91 and 92 are provided and electrical power is supplied thereto in a conventional manner. An ON-OFF switch 93 is connected in series with the line 91 to control the application of electrical power to the circuit components. In order to, for example, activate the pre-size clamp 77, switch 94 is closed to activate a control relay CR1 and, simultaneously therewith, the clamp. A relay contact CR1-1 of the control relay CR1 changes state from normally open to closed to lock in the activation of the control relay CR1 and the clamp. To deactivate the pre-size clamp, a STOP switch 96 is activated. Similarly, a switch 97 is closed to activate the stripper clamp 78. This causes an activation of the control relay CR2 so that a contact thereof, namely, contact CR2-1 to change state from a normally open condition to a closed condition to result in a locked in activation of not only the control relay CR2 but also the stripper clamp 78. To deactivate the stripper clamp, the STOP switch 97A is activated.

The ram drive cylinder 24 is controlled by two control relays CR3 and CR4. For example, a switch 98 is capable of moving back and forth between two sets of contacts 99 and 101. If it is desired to move the ram up, the switch 98 is moved to contact the set of contacts 99 to effect an activation of the control relay CR3. Activation of the control relay CR3 causes the contacts thereof CR3-1 and CR3-2 to become closed and the ram will continue to move upwardly until contact with a limit switch LS-1 which will become open to stop the upward movement of the ram. Stopping at intermediate points can be accomplished by activating the STOP switch 102. When it is desired to move the ram down, the switch 98 can be moved to a set of contacts 101 to accomplish that objective as well. The limit switch LS-2 and the STOP switch 102A serve the purpose of limiting the downward movement of the ram.

When it is desired to move the screws 29 to differing positions, a switch 103 is moveable to select one of the sets of contacts 104 and 106. The limit switches LS-3 and LS-4 and the stop switches 105 and 105A serve to limit the upward and downward movement of the screws, respectively. The control relays CR5 and CR6 operate in the same manner as has been described above with respect to the control relays CR1-CR4 and the sets of contacts thereon, namely, CR5-1, CR5-2, CR6-1 and CR6-2, respectively, operate also in the same manner.

When the set of contacts, for example, CR3-2 become closed, the ram drive cylinder will be driven upwardly. If it is desired to jog the ram drive cylinder for movement in small increments, a JOG-UP switch 107 can be activated. Similarly, a JOG-DN switch 108 can be activated to jog the drive cylinder through incremental small steps in a downward direction. In a similar fashion, the screw motor M can be driven in a clockwise direction, namely, causing the screws to move in an upward direction when the contact CR5-2 of the control relay CR5 become closed. Similarly, a JOG-UP switch 109 can be activated to increment the screw in a clockwise direction. A JOG-DN switch 111 can be used to effect the reverse rotation of the screw, namely, a counter clockwise direction causing the screw to be moved intermittently in a downward direction. The position display for the screw is displayed on a screen $S_1$ through conventional transducer circuitry. Similarly, the position of the stripper plate to which the ram drive cylinder is connected is displayed on a screen $S_2$ through conventional transducer circuitry.

An automated operation control system is also provided and can be activated by moving a switch 112 between a MANUAL and an AUTO set of contacts. Similarly, the automated operation control system can be activated by opening the switch 113.

The valve $V_2$ is a normally open valve which, when activated, becomes closed to prevent the flow of fluid therethrough. If desired, a switch can be provided for manually controlling the valve $V_2$. However, in this particular embodiment, the automated operation control system effects a timely control of the valve $V_2$ to cause the valve $V_2$ to become closed when the ram drive cylinder reaches its bottom most stroke and the limit switch LS-2 becomes open. The valve $V_2$ becomes opened again when the ram has been raised to a predetermined height relative to the receiver 11.

Broken lines are shown in FIG. 8 and extend between the automated operation control system and the aforementioned valve $V_2$ and the control relays CR2, CR3 and CR4. Proper sequencing of the control relays CR2, CR3 and CR4 will enable an assembly of fins to be properly assembled into a finished coil construction.

Figure 5:
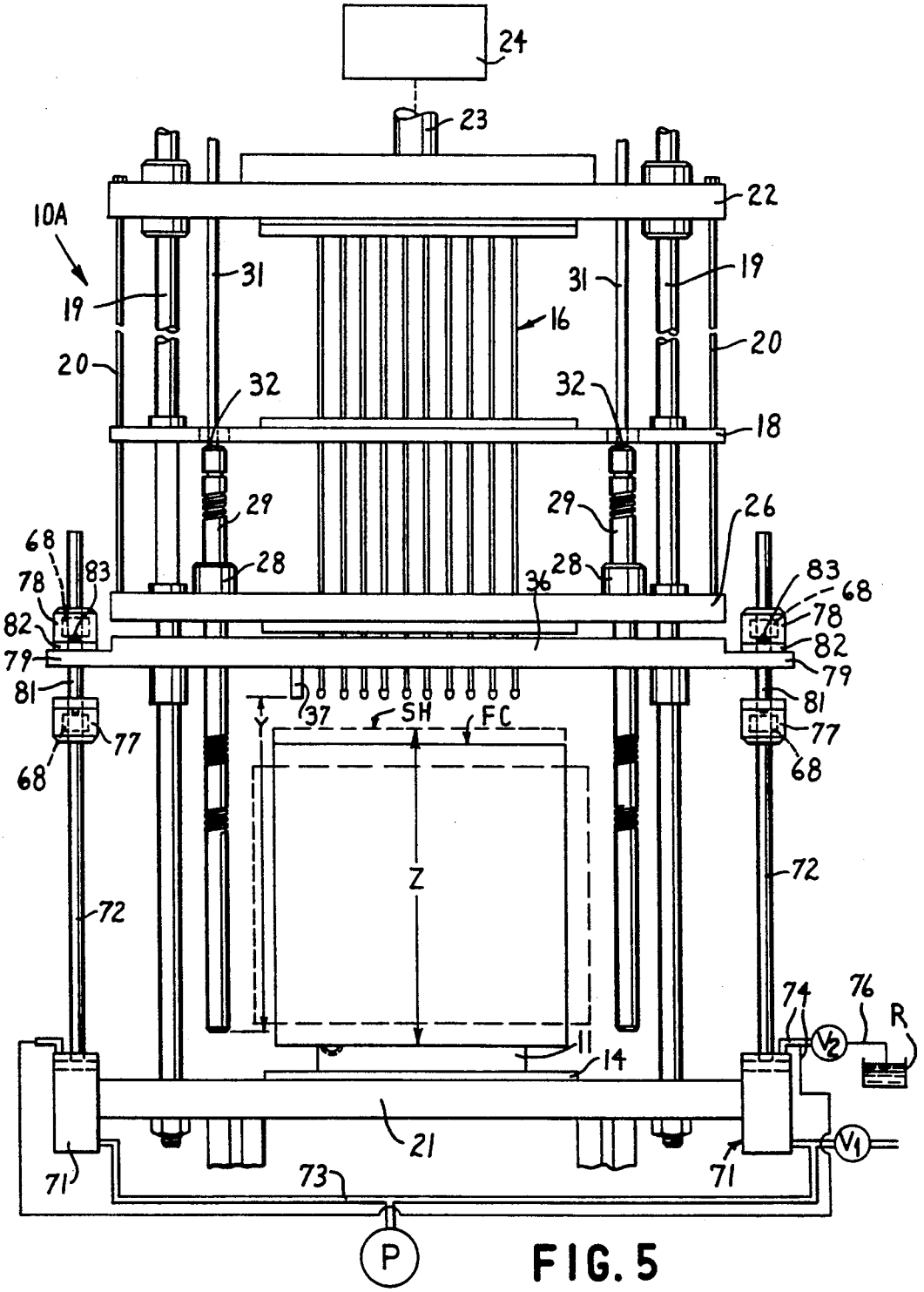
FIG. 5 is a front view of the mechanical expander illustrate in FIG. 4.
Figure 6:
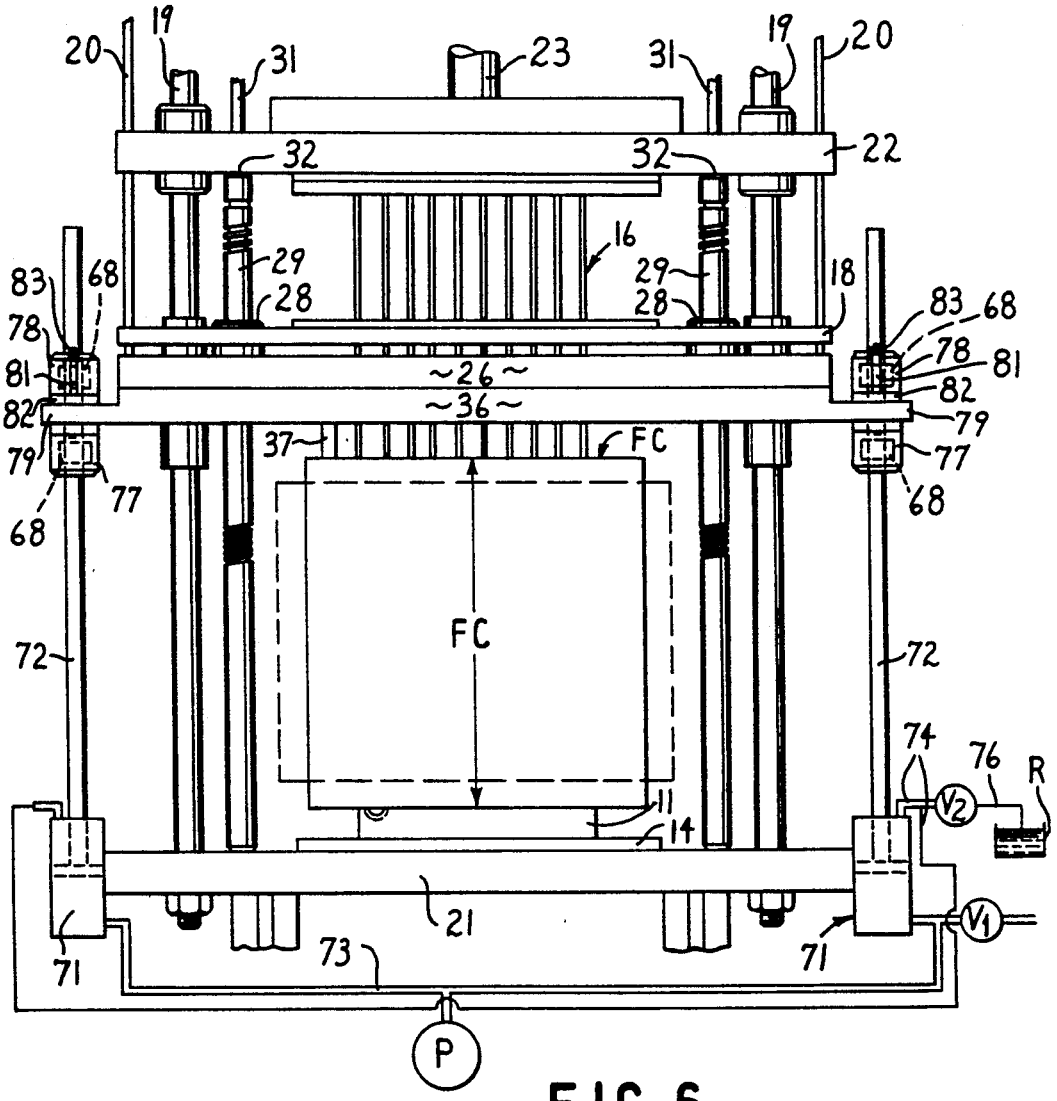
FIG. 6 is a front view of the mechanical expander illustrated in FIG. 5, but with the component parts thereof in a position whereat the final coil height is set.

In order to effect a setup operation of the mechanical tube expander illustrated in FIGS. 4–6, the press drive cylinder, namely, the piston and cylinder assembly 24 is retracted so that the pressure plate 22 is first moved to the uppermost limit position. This is caused by a moving of the selector switch 98 to the upper contact to activate a control relay CR3 which becomes locked on by the closing of a normally open relay contact CR3-1 on the control relay CR3. Similarly, normally open contacts CR3-2 on the control relay CR3 will also close thereby activating the press drive cylinder 24 to retract the ram until the normally closed limit switch LS-1 is opened thereby deactivating the control relay CR3 and causing the contacts thereof CR3-1 and CR3-2 to open. Thereafter, the screws 29 can be rotated by activating a drive motor 86 (FIG. 4) therefor and, through an appropriate transmission mechanism 87, causing both screws 29 to synchronously rotate and be moved upwardly or downwardly relative to the nuts 28 at the same rate thereby keeping the upper ends 32 of the screws in a coplanar arrangement. An encoder 88 is provided to monitor the number of rotations of the screws 29 and to thereby indicate the distance that the lower end of the screw 29 is from the expander plate 26. The screws will be adjusted either up or down until the correct screw position is displayed on the screen $S_1$. Assume, for the moment, that the dimension for the finished coil is known to be 50 inches. Thus, the display on the screen $S_1$ will be adjusted to 50.000 inches. Careful play with the switches, including the selector switch 103 and the JOG-UP switch 109 and the JOG-DN switch 111 will enable an accurate positioning of the screw until the Y dimension is at the appropriate distance for a 50 inch finished coil (See FIG. 5) and the display in $S_1$ is at the desired 50.000 inches. Thereafter, the ram 23 can be driven downwardly through an appropriate activation of the selector switch 98 as well as intermittent operation of the ram JOG-UP and ram JOG-DN switches 107 and 108, respectively to position the stripper plate at the coil pre-size location which, for a 50.000 inch finished coil height and assuming about a 3% shrink, is 51.546 inches in this particular embodiment. A transducer (not shown) will provide at all times the position $X_2-X_1$, or Z or pre-size height so that the dimension Z is properly displayed on the screen $S_2$. The transducer has a 9.500 offset, hence when the screen $S_2$ displays 51.546, then $X_2$ (FIG. 7A) would be 61.046. This is when the pre-size clamp 77 should be locked. Thus when the ram is lowered from the FIG. 7A position to the FIG. 7B position or 9.500, then $Z=51.546$, namely, the pre-size height. Screen $S_2$ is only used for setting up in FIG. 7A. After the pre-size clamps are locked, the screen data is unimportant until the next height change $X_2-X_1=Z=SH$. Since the dimension $X_1$ is 9.500 inches, the pre-size clamp 77 will always be 9.500 inches below the stripper plate 36, at which time the pre-size clamp 77 can be activated and the letter "C" appearing in FIG. 7A designates that the clamp 77 is in the "clamped" condition. The screen $S_2$display is not, as stated above, important from here on. The stripper clamp 78 remains unclamped and the "U" symbol designates such in FIG. 7A. The aforementioned adjustments were all made without the operator needing to leave the control panel CP. Once an assembly of fins has been placed on to the receiver 11, the operator can thereafter activate the automated control system and a coil assembly operation will take place automatically with the pre-size clamp 77 and stripper clamp 78 operating in the manner illustrated in FIGS. 7A–7F. If, on the other hand, the Z and FC dimensions in FIGS. 7B and 7C or the Z dimension in FIG. 5 or the FC dimension in FIG. 6 needs to be determined by trial and error to accommodate a coil of a different size, such manipulation of the screws and pre-size clamp 77 can be easily and quickly accomplished.

Figures 7A, 7B, 7C:
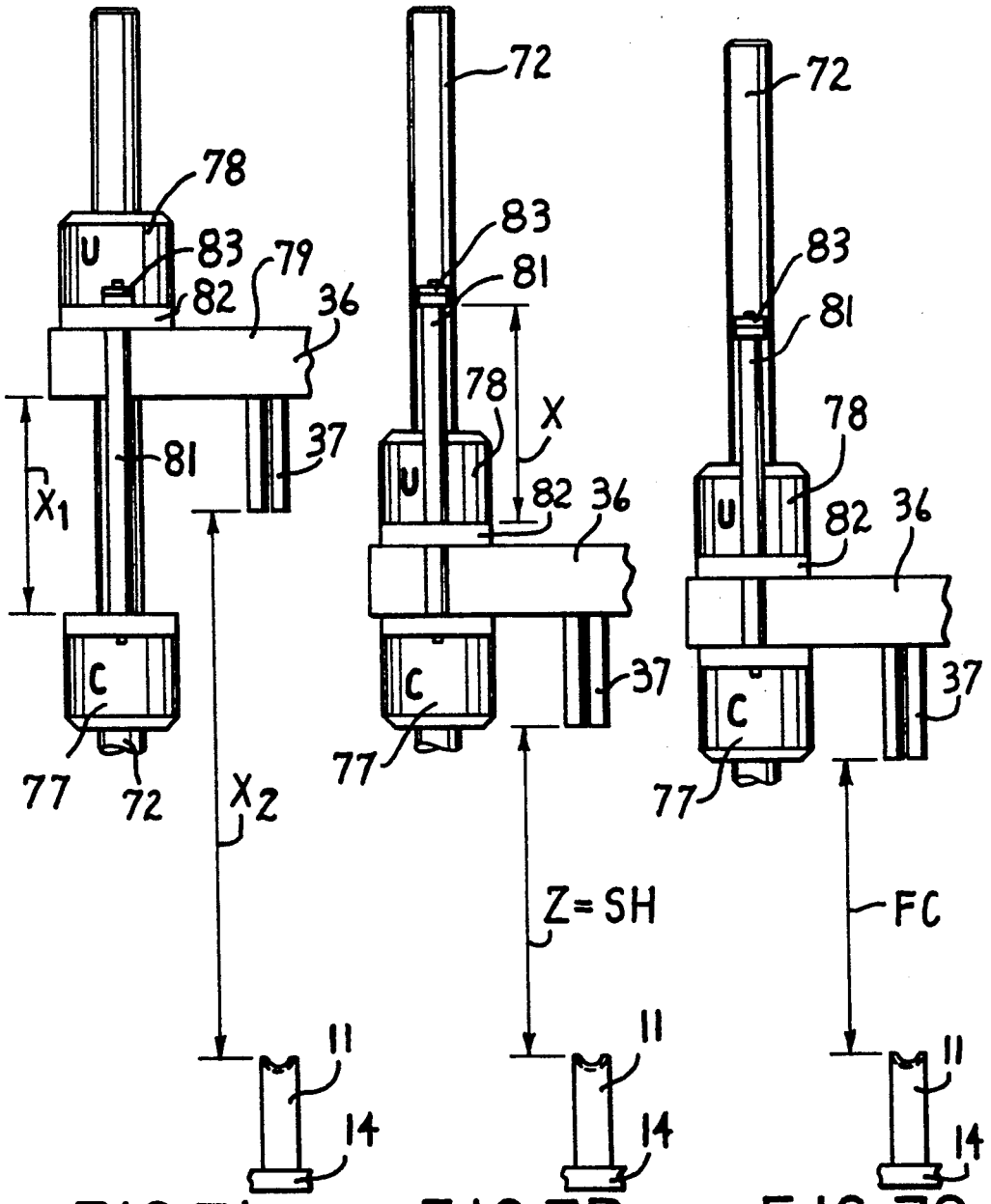
FIGS. 7A–7F illustrate a sequence of movements of component parts of the mechanical tube expander during a coil assembly task.
Figures 7D, 7E, 7F:
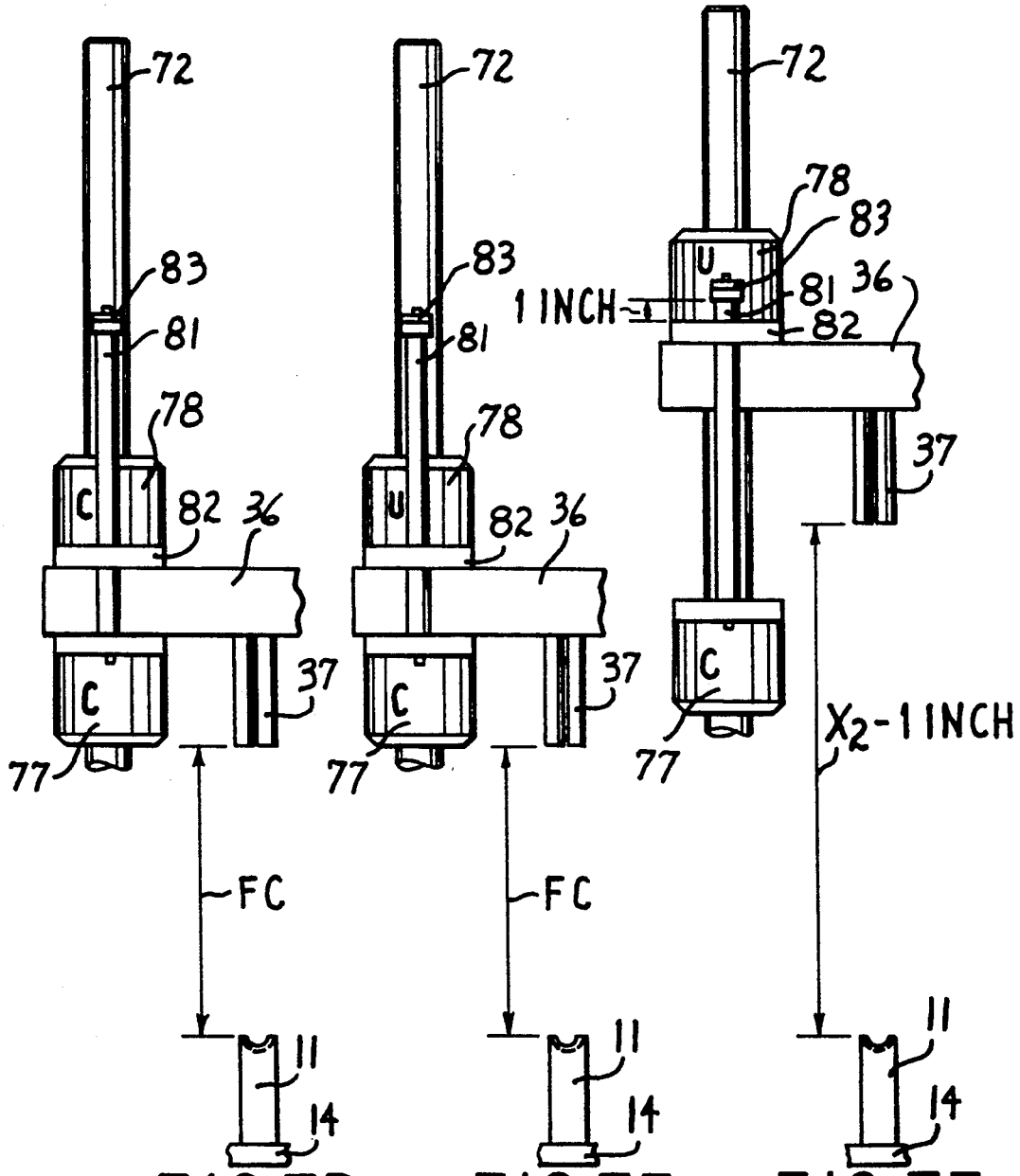

The automated operation control system will first bring the stripper plate 36 from the position illustrated in FIG. 7A to the position illustrated in FIG. 7B wherein the stripper plate 36 rests on the upper surface of the pre-size clamp 77. Dimension Z is the pre-size size dimension for a 50 inch coil and is 51.546 inches. It is to be noted that dimension $X_1$ substrated from dimension $X_2$ will equal dimension Z. The press drive cylinder 24 will continue to drive the piston rod 23 downwardly to force the bullets 17 through the tubes T to cause the fins to become interlocked with the tubes T. During this process, shrinkage of the assembly of fins and tubes from a starting height SH or pre-size height will occur, as depicted in FIG. 5. As the ram drive cylinder 24 continues urging the pressure plate 22 downwardly, the pressure plate 22 contacts the surfaces 32 to cause the expander plate 26 to push the stripper plate 36, which causes the lateral extension 79 to force the pre-size clamp 77 down. Since the pre-size clamp 77 is clamped to the piston rod 72, the piston rod 72 is also urged downwardly. The pre-size clamps 77 clamped to the piston rods 72 will be pushed downwardly to cause the piston rods 72 to be retracted within the piston and cylinder assemblies 71 until the finished coil size FC is reached as illustrated in FIG. 7C and as determined by the bottom end of each screw 29 nearing the upper surface of the bolster plate 21. It is preferable that the limit switch LS-2 open when the bottom end of the screws 29 are spaced about 1 mm from the bolster plate 21. This can be accomplished, for example, by the utilization of a proximity switch on the bolster plate 21, serving the limit switch LS-2, which proximity switch would detect the presence of the lower end of the screws 29 to halt further downward movement of the ram 23. Other suitable locations of the limit switch LS-2 are also possible. Thereafter, the automated control system effects an activating of the stripper clamp control relay CR2 to activate the stripper clamp 78 as schematically illustrated by the C in FIG. 7D and close the valve $V_2$. While the stripper clamp and pre-size clamp 77 both remain in the clamped condition illustrated in FIG. 7D, the press drive cylinder 24 will retract the ram or piston rod 23 as well as the expander rods 16 and bullets 17 thereon from the tubes T until the bullets 17 are positioned adjacent the upper open ends of the tubes T. All during a retraction of the bullets 17 from the tubes T, the closed valve $V_2$ prevents the escape of oil from the upper end of the piston and cylinder assembly 71 to fixedly position the piston rods 72 in their lowered position illustrated in FIGS. 7C–7E. As shown in FIG. 7E, the stripper clamp 78 is unclamped and the press drive cylinder 24 is allowed to continue to retract the ram 23 to eventually cause the stripper plate 36 to rise from the position illustrated in FIG. 7E. Shortly after the stripper plate rises off of the pre-size clamps 77, the valve $V_2$ is opened to allow the pressurized air from the source P to push the pistons upwardly in the piston and cylinder assembly 71 to drive the oil back into the reservoir R through the now opened valve $V_2$. The ram cylinder continues to retract to allow the pressure plate 22 to lift the expander plate 26 and stripper plate 36. The limit switch LS-1 will open to halt further upward movement of the ram 23 after sufficient space has been provided to allow for removal of an assembled coil and inserting an assembly of fins to be finished. As a result of this last mentioned step, the stripper plate 36 and the pre-size clamp as well as the stripper clamp are oriented to the FIG. 7F position at which time the mechanical tube expander is ready for the next cycle of operation.

It is conceivable, and within the purview of a person skilled in the art of machine control, that an operator could know in advance from experience the finished coil height, the pre-size coil dimension (SH) and the amount of shrink for a particular coil model. All that the operator would need to do is to input the coil model number into a control module on the control panel (not illustrated) preprogrammed with the above information so as to enable the control module to set the parameters on the expander automatically.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a mechanical tube expander for expanding hairpin or straight tubes into interlocked relationship with fins, comprising a frame means, a receiver mounted on said frame means for supporting the tubes and an assembly of the fins loosely stacked on the tubes, a pressure plate means carrying a plurality of expander rods which are aligned with the tubes, said expander rods having tube-expanding means at one end thereof, first drive means for reciprocating said pressure plate and expander rods with respect to the assembly with said tube-expanding means received inside the tubes in order to cause an expanding of the tubes into interlocked relationship with the fins that are stacked thereon, a stripper plate means having plural guide openings therethrough through which extend said expander rods for engaging the assembly of fins on an end thereof remote from said receiver, said stripper plate means being movable relative to said frame means toward and away from said receiver by said first drive means, a pair of laterally spaced internally threaded nuts provided on said stripper plate means, an elongated pressure screw threadedly received in each said threaded nut, and a second drive means for simultaneously rotatably turning said pressure screws relative to said nuts, the improvement wherein a quick height adjustment mechanism to accommodate assemblies of fins of differing height is provided, said mechanism comprising:

a pair of fluid cylinders on laterally opposite sides of said frame means, said fluid cylinders each having means defining a main chamber therein, each main chamber having a reciprocal piston therein connected to an elongated piston rod extending parallel to said expander rods, each said piston dividing said main chamber into first and second chambers;

a fluid source of compressible fluid and a connection means for facilitating a connection of said second chamber to said fluid source;

valve means between said fluid source and said second chamber for continuously providing a supply of compressible fluid to said second chamber;

first and second block members slidably mounted on each of said piston rods and for movement longitudinally thereof, said first block member being also mounted on and movable with said stripper plate means and is oriented on a side of said stripper plate means remote from said receiver;

third support means for suspending each said second block member from said stripper plate means and providing a limit distance that each said second block member is suspended along said piston rods away from said first block members and said stripper plate means;

releasable clamping means on each said first and second block member for fixedly clamping said first and second block member to a said piston rod; and control means for effecting a complete cycle of operation to cause the tubes to be expanded into interlocked relationship with the fins.

2. In a mechanical tube expander for expanding hairpin or straight tubes into interlocked relationship with fins, comprising a frame means, a receiver mounted on said frame means for supporting the tubes and an assembly of the fins loosely stacked on the hairpin tubes, a pressure plate means carrying a plurality of expander rods which are aligned with the tubes, said expander rods having tube-expanding means at one end thereof, first drive means for reciprocating said pressure plate and expander rods with respect to the assembly with said tube-expanding means received inside the tubes in order to cause an expanding of the tubes into interlocked relationship with the fins that are stacked thereon, a stripper plate means having plural guide openings therethrough through which extend said expander rods for engaging the assembly of fins on an end thereof remote from said receiver, said stripper plate means being movable relative to said frame means toward and away from said receiver by said first drive means, a pair of laterally spaced internally threaded nuts provided on said stripper plate means, an elongated pressure screw threadedly received in each said threaded nut, and a second drive means for simultaneously rotatably turning said pressure screws relative to said nuts, the improvement wherein a quick height adjustment mechanism to accommodate assemblies of fins of differing height is provided, said mechanism comprising:

a pair of fluid cylinders on laterally opposite sides of said frame means, said fluid cylinders each having means defining a main chamber therein, each main chamber having a reciprocal piston therein connected to an elongated piston rod extending parallel to said expander rods, each said piston dividing said main chamber into first and second chambers;

a fluid source of compressible fluid and a connection means for facilitating a connection of each said second chambers to said fluid source and a continuous urging of said pistons toward one end of said main chamber;

first and second block members slidably mounted on each of said piston rods and for movement longitudinally thereof, said first block member being also mounted on and movable with said stripper plate means and is oriented on a side of said stripper plate remote from said receiver;

third support means for suspending each said second block member from said stripper plate means and providing a limit distance that each said second block member is suspended along said piston rods away from said first block members and said stripper plate means;

releasable clamping means on each said first and second block member for fixedly clamping said first and second block member to a said piston rod; and control means for facilitating an initial setup of said mechanical tube expander to accommodate a desired height of an assembly of fins by (1) driving said first drive means to move at least said stripper plate means and said second block members suspended therefrom to a first location relative to said piston rods corresponding to a pre-size height for the assembly of fins and, thereafter, (2) activating said releasable clamping means to effect a fixed clamping and thereby a fixed orientation of said second block members on said piston rod at said first location, (3) driving said second drive means to effect a rotating of said pressure screws relative to said nuts to effect a movement of each said pressure screw toward or away from said receiver to thereby establish a length of each said pressure screw extending away from said nut on a side thereof remote from said pressure plate means so that at the completion of a tube expansion, the finished coil height is obtained and at which time the driving thereof is halted, and (4) a moving of said stripping plate means away from said second block members a distance equal to or less than said limit distance provided by said third support means, after which a cycle of operation of said mechanical tube expander can begin.

3. In a mechanical tube expander for expanding tubes into interlocked relationship with fins, comprising a frame means, a bolster frame mounted on said frame means, a receiver mounted on said bolster frame for supporting the tubes and an assembly of the fins loosely stacked on the tubes, a pressure plate carrying a plurality of expander rods which are aligned with the tubes said expander rods having tube-expanding means at one end thereof, first drive means for reciprocating said pressure plate and expander rods with respect to the assembly in order to expand the tubes into interlocked relationship with the fins that are stacked thereon, an expander plate suspended from said pressure plate and having means thereon for expanding the diameter of exposed free ends of said tubes, first support means for facilitating a relative movement of said pressure plate toward said expander plate while simultaneously limiting the extent to which said pressure plate can move away from said expander plate, a pair of laterally spaced internally threaded nuts provided on said expander plate, an elongated pressure screw threadedly received in each said threaded nut, and a second drive means for simultaneously rotatably turning said pressure screws relative to said nuts, and a stripper plate having plural guide openings therethrough through which extend said expander rods, said stripper plate engaging the assembly of fins on an end thereof remote from said receiver, said stripper plate being movable relative to said frame means toward and away from said receiver by said first drive means, and second support means for facilitating a relative movement of said expander plate toward said stripper plate while simultaneously limiting to a finite defined distance the extent to which said expander plate can move away from said stripper plate, the improvement wherein a quick height adjustment mechanism to accommodate assemblies of fins of differing height is provided, said mechanism comprising:

a pair of fluid cylinders on laterally opposite sides of said frame means, said fluid cylinders each having means defining a main chamber therein, each main chamber having a reciprocal piston therein connected to an elongated piston rod extending parallel to said expander rods, each said piston dividing said main chamber into first and second chambers;

a first fluid source and a first connection means for facilitating a connection of said first chamber to said first fluid source, said first fluid source being a source for an incompressible fluid;

a second fluid source and a second connection means for facilitating a connection of said second chamber to said second fluid source, said second fluid source being a source for a pressurized compressible fluid;

first valve means between said first fluid source and said first chamber for respectively providing fluid communication and blocking fluid communication between said first fluid source and said first chamber;

second valve means between said second fluid source and said second chamber for continuously providing a supply of pressurized compressible fluid to said second chamber and a venting of said pressurized compressible fluid to a low pressure area when the pressure thereof exceeds a predetermined value;

first and second block members slidably mounted on each of said piston rods and for movement longitudinally thereof, said first block member being also mounted on and movable with said stripper plate and is oriented on a side of said stripper plate remote from said receiver;

third support means for suspending each said second block member from said stripper plate and providing a limit distance that each said second block member is suspended along said piston rods away from said first block members and said stripper plate;

releasable clamping means on each said first and second block member for fixedly clamping said first and second block member to a said piston rod; and control means for effecting a complete cycle of operation to cause the tubes to be expanded into interlocked relationship with the fins.

4. In a mechanical tube expander for expanding tubes into interlocked relationship with fins, comprising a frame means, a bolster frame mounted on said frame means, a receiver mounted on said bolster frame for supporting the tubes and an assembly of the fins loosely stacked on the tubes, a pressure plate carrying a plurality of expander rods which are aligned with the tubes, said expander rods having tube-expanding means at one end thereof, first drive means for reciprocating said pressure plate and expander rods with respect to the assembly in order to expand the tubes into interlocked relationship with the fins that are stacked thereon, an expander plate suspended from said pressure plate and having means thereon for expanding the diameter of exposed free ends of said tubes, first support means for facilitating a relative movement of said pressure plate toward said expander plate while simultaneously limiting the extent to which said pressure plate can move away from said expander plate, a pair of laterally spaced internally threaded nuts provided on said expander plate, an elongated pressure screw threadedly received in each said threaded nut, and a second drive means for simultaneously rotatably turning said pressure screws relative to said nuts, and a stripper plate having plural guide openings therethrough through which extend said expander rods, said stripper plate engaging the assembly of fins on an end thereof remote from said receiver, said stripper plate being movable relative to said frame means toward and away from said receiver by said first drive means, and second support means for facilitating a relative movement of said expander plate toward said stripper plate while simultaneously limiting to a finite defined distance the extent to which said expander plate can move away from said stripper plate, the improvement wherein a quick height adjustment mechanism to accommodate assemblies of fins of differing height is provided, said mechanism comprising:

a pair of fluid cylinders on laterally opposite sides of said frame means, said fluid cylinders each having means defining a main chamber therein, each main chamber having a reciprocal piston therein connected to an elongated piston rod extending parallel to said expander rods, each said piston dividing said main chamber into first and second chambers;

a first fluid source and a first connection means for facilitating a connection of said first chamber to said first fluid source, said first fluid source being a source for an incompressible fluid;

a second fluid source and a second connection means for facilitating a connection of said second chamber to said second fluid source, said second fluid source being a source for a pressurized compressible fluid;

first valve means between said first fluid source and said first chamber for respectively providing fluid communication and blocking fluid communication between said first fluid source and said first chamber;

second valve means between said second fluid source and said second chamber for continuously providing a supply of pressurized compressible fluid to said second chamber and a venting of said pressurized compressible fluid to a low pressure area when the pressure thereof exceeds a predetermined value;

first and second block members slidably mounted on each of said piston rods and for movement longitudinally thereof, said first block member being also mounted on and movable with said stripper plate and is oriented on a side of said stripper plate remote from said receiver;

third support means for suspending each said second block member from said stripper plate and providing a limit distance that each said second block member is suspended along said piston rods away from said first block members and said stripper plate;

releasable clamping means on each said first and second block member for fixedly clamping said first and second block member to a said piston rod; and control means for facilitating an initial setup of said mechanical tube expander to accommodate a desired height of an assembly of fins by (1) driving said first drive means to move at least said stripper plate means and said second block members suspended therefrom to a first location relative to said piston rods corresponding to a pre-size height for the assembly of fins and, thereafter, (2) activating said releasable clamping means to effect a fixed clamping and thereby a fixed orientation of said second block members on said piston rod at said first location, (3) driving said second drive means to effect a rotating of said pressure screws relative to said nuts to effect a movement of each said pressure screw toward or away from said receiver to thereby establish a length of each said pressure screw extending away from said nut on a side thereof remote from said pressure plate means so that at the completion of a tube expansion, the finished coil height is obtained and at which time the driving thereof is halted, and (4) a moving of said stripping plate means away from said second block members a distance equal to or less than said limit distance provided by said third support means, after which a cycle of operation of said mechanical tube expander can begin.

* * * * *